United States Patent [19]

Thoma et al.

[11] Patent Number: 4,895,625

[45] Date of Patent: Jan. 23, 1990

[54] METHOD FOR PRODUCING A GALVANICALLY DEPOSITED PROTECTION LAYER AGAINST HOT GAS CORROSION

[75] Inventors: Martin Thoma; Monika Bindl; Paul Buenger, all of Munich; Josef Linska, Grafing, all of Fed. Rep. of Germany

[73] Assignee: MTU Motoren-und Turbinen-Union Muenchen GmbH, Munich, Fed. Rep. of Germany

[21] Appl. No.: 349,211

[22] Filed: May 9, 1989

[30] Foreign Application Priority Data

May 10, 1988 [DE] Fed. Rep. of Germany ..... 3815976

[51] Int. Cl.[4] ..... C25D 5/50

[52] U.S. Cl. ..... 204/16; 204/37.1

[58] Field of Search ..... 204/16, 37.1

[56] References Cited

PUBLICATIONS

"Plating and Surface Finishing", article entitled: Electrodeposits for High-Temperature Corrosion Resistance by F. J. Honey et al., pp. 42–46, Oct., 1986.

*Primary Examiner*—T. M. Tufariello

*Attorney, Agent, or Firm*—W. G. Fasse; D. H. Kane, Jr.

[57] ABSTRACT

Galvanically or electrolytically deposited protective coatings are produced on structural components such as gas turbine blades by suspending in the electrolytic solution a metal alloy powder of which the particles have a spherical configuration and a passivated surface. The concentration of the particles in the electrolyte is preferably smaller than 100 g/l, whereby a high insertion rate of up to 45% by volume has been achieved at relatively low costs and small technical efforts.

11 Claims, 3 Drawing Sheets

METHOD FOR PRODUCING A GALVANICALLY DEPOSITED PROTECTION LAYER AGAINST HOT GAS CORROSION

FIELD OF THE INVENTION

The invention relates method for galvanically depositing protection layers against hot gas corrosion, for example, in the manufacture of gas turbines.

BACKGROUND INFORMATION

In the construction of gas turbines efforts are being made to ever improve the characteristics of thermally highly loaded structural components, especially the turbine blades of the first turbine stage. Thus, it is known to obtain improvements in the resistance against high temperature loads by the application of highly effective protection layers against corrosion. It is known that metal coatings or protective layers made of an MCrAlY alloy are especially suitable for this purpose. In the just mentioned alloy the M stands for nickel, cobalt, or an alloy of the two. Under special circumstances iron may also take the place of the letter M.

The protection effect with regard to the surface to be protected, is based on the fact that the chromium and aluminum form oxides at these high temperatures, namely $Cr_2O_3$ and $Al_2O_3$. These oxides form protective films which prevent any further oxidation.

The alloys used conventionally comprise about 15% to 25% of chromium, 10% to 15% of aluminum, 0.2% to 0.5% of yttrium, and the rest being represented by the M, as mentioned above, whereby the indicated percentages are weight percentages. The proportion of aluminum and chromium should be as high as possible in order to make sure that the above mentioned protecting effect by way of forming an oxide layer can function to the required extent. Conventional application methods employ the thermal spraying as well as physical vapor deposition techniques, whereby the required proportion of chromium, aluminum, and yttrium in the layer is obtained. A disadvantage of thermal spraying and physical vapor deposition methods is their high production costs. Thus, tests have been made to apply these protective coatings by a dispersion coating technique because dispersion coating is substantially more economical compared to the above mentioned two methods. However, dispersion coating has also disadvantages. Thus, conventional dispersion coating methods could achieve only small insertion rates of the suspension powder in the metal matrix. The insertion rates are in the order of about 20% by volume, whereby it is not possible to achieve the required high chromium and aluminum content proportion. As a result, the protective coating does not have the required quality. Useful protection coating qualities would require a proportion of more than 40% by volume of the chromium and aluminum in order to achieve the same coating or film quality as can be achieved by means of physical vapor deposition or plasma spraying methods.

An article published in the trade journal "Plating and Surface Finishing" of October 1986, page 42, describes a method which is intended to avoid the above mentioned disadvantages of the dispersion coating method. In this known method a suspension filled drum having partially porous walls is rotated in an electrolytic bath. The substrates to be coated are attached inside the rotating drum. Relatively high insertion rates are achieved by this method. However, the rotating drum method also has a disadvantage, namely that the resulting coating or film is very non-uniform. A particularly undesirable characteristic of the rotating drum method is seen in the fact that substantial wart-like depositions are formed. In connection with the coating of turbine blades, the known method results in thicker coatings along the blade edges than in the central blade areas. This disadvantageous effect could, theoretically, possibly be avoided by mounting screens or so-called shutters inside the drums. However, such possibility is really not practical because it is likely to cause electrical short circuits through the electrolyte. Thus, the problem cannot be easily avoided. Another disadvantage of the rotating drum dispersion method resides in the fact that it is rather time consuming and therefore is not suitable for an economical large scale production.

Another substantial disadvantage of conventional dispersion coating methods resides in the fact that frequently a very porous layer structure is obtained which additionally has a rough surface which is dotted with dendritic patterns so that the desired corrosion protection is rather non-uniform over the surface area to be protected.

OBJECTS OF THE INVENTION

In view of the foregoing it is the aim of the invention to achieve the following objects singly or in combination:

- to avoid the above outlined disadvantages, more specifically, to improve a dispersion coating method so that it will become economically feasible, especially for large scale production;
- to provide a dispersion coating method which achieves a uniform high quality protective coating against hot gas corrosions without undesirable coating characteristics; and
- to obtain insertion rates exceeding 40% by volume of the suspension powder in the metal matrix in the finished coating.

SUMMARY OF THE INVENTION

According to the invention there is provided a dispersion coating method for producing galvanically deposited protection coatings or films against hot gas corrosion. The corrosion protective coating includes a cobalt and/or nickel matrix having embedded metal alloy particles. An electrolytic bath is used for the coating. The matrix metal cobalt and/or nickel is part of the electrolyte. The chromium and/or aluminum containing metal alloy powders are suspended in the electrolyte. The metal alloy powder is either a chromium or an aluminum base alloy. After the deposition in the electrolytic bath, the coated component is subjected to a heat treatment for the cobalt and/or nickel layers holding the alloy powder particles, whereby the heat treatment causes the alloying. The metal alloying powder is a powder in which the particles have a spherical shape and a passivated surface. Further, the suspension concentration of the spherical powder particles is smaller than 100 g/l in the electrolytic suspension, preferably within the range 40 g/l to 100 g/l.

The protective coatings or films produced according to the invention have an insertion rate of up to 45% by volume, whereby the same coating or film quality is obtained as is possible with conventional physical vapor deposition or plasma spraying methods. However, the method according to the invention has substantially smaller production costs. For example, compared to thermal plasma spraying, the present production costs are only about 10% of the conventional costs.

According to the present teaching the heat treatment takes place in a vacuum to provide a diffusion annealing, whereby the alloy formation starts and the resulting film or protection coating quality is identical to the quality of known coatings produced by thermal spraying.

The low suspension concentration of 100 g/l makes it possible to advantageously use simple conventional dispersion coating techniques, whereby the expenses are substantially smaller than, for example, the expenses required for practicing the above mentioned rotating drum technique, especially with regard to a continuous large scale manufacturing operation. The rotating drum technique operates normally with a bath concentration of at least 600 g/l. However, in order to obtain useful insertion rates, the bath concentration for the rotating drum operation must be about 5000 g/l as has been shown by comparing tests.

On the other hand, according to the invention, useful insertion rates have been achieved with a bath or suspension concentration of 40 to 60 g/l.

Conventionally, the shape and other characteristics of the powder particles have apparently been considered to be not significant. Contrary thereto, according to the invention, it has been found that the powder particles having a spherical configuration and a passivated surface permit substantially higher insertion rates than is conventionally possible, especially with conventionally milled powders. As a result, the invention can, surprisingly, lower the suspension concentration substantially while simultaneously increasing the quality of the protective coating or film.

It has been found that especially passivating the particle surface contributes to a uniform film or layer structure. Such uniformity is due to the fact that a particle deposited and adhering to the substrate is nonconducting and thus does not cause any negative changes in the flux lines surrounding the particle in the electrolytic bath. As a result, the embedding of the particles in the matrix material is advantageously undisturbed and the particle is coated with matrix material to an extent more than necessary, which is desirable. The above mentioned concentration of particles in the suspension in the range of 40 to 60 g/l is preferred since it has been found that within this concentration range the resulting coating is especially uniform.

The preferred metal powder for use in the present method is a powder of chromium, aluminum, and yttrium because the protective coating achievable with this type of powder has especially good corrosion protection characteristics. However, the type of powder mixture will depend on the particular requirements that must be met by the coating or film characteristics, especially with regard to the bonding ability of the protective coating on the substrate or with regard to its resistance relative to special gas mixtures, for example, involving sulphur corrosion, vanadium corrosion or the like. In such instances one or several of the following alloys can be used as the powder CrAlHf, CrAlYHf, CrAlTa, CrAlYTa, CrNiAl, CrCoAl, CrAlSi, CrAl, MoCrSi.

An especially simple cost effective production of the suspension powder is provided by manufacturing the powder through nozzle spraying, also referred to as atomizing. By adjusting the atomizing parameters, such as the surrounding gas atmosphere, advantageous values for the particle diameter, and for the extent of the surface passivating can be obtained. Normally, the particle size will have diameters within the range of 1 to 15 μm.

Preferably, the suspension is maintained by introducing air into the suspension or by keeping the suspension in circulation by means of a pump and/or by a stirring mechanism for maintaining a uniform particle distribution throughout the volume of the electrolyte. Compared to the rotating drum method, the present method can achieve a simplification of the production as well as a good continuous mixing of the particles in the electrolyte.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND INCLUDING THE BEST MODE OF THE INVENTION AND OF COMPARING EXAMPLES

Example 1 According to the Invention

Figure 1:
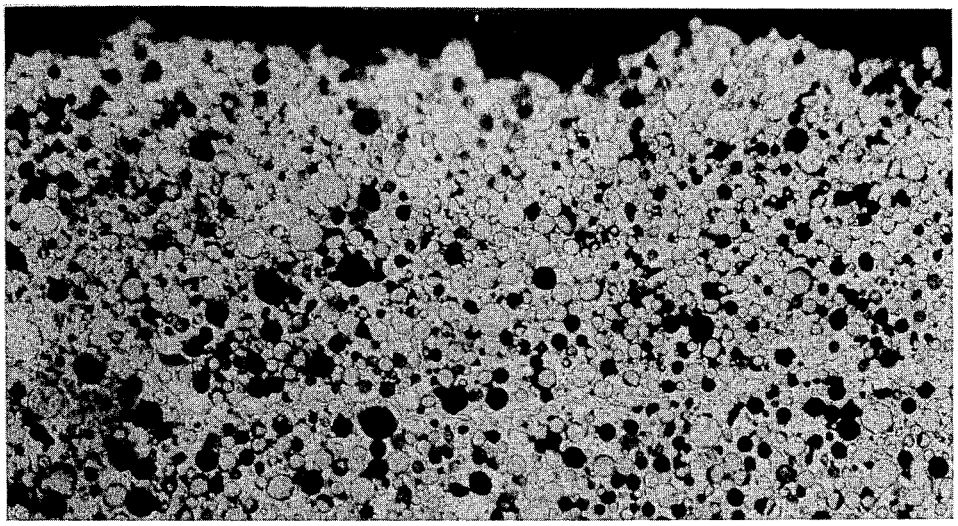
FIG. 1 is a micrograph at a magnification of 500 X showing a polished section through a protective coating produced according to the invention.

An electrolytic bath is produced for use in a conventional dispersion coating apparatus. The electrolytic suspension comprises a cobalt electrolyte with the following ingredients 400 g/l of $CoSO_4$, 35 g/l of $H_3BO_3$, and 20 g/l of NaCl, whereby a pH-value is adjusted within the range of 4.5 to 4.7. Powder particles of CrAlY having a spherical configuration and a passivated surface are mixed into the electrolyte, whereby the particle size was below 10 μm. The addition of the powder particles was continued until the suspension concentration was 100 g/l. Thereafter, turbine blades to be coated were electrically connected to the cathode and immersed into the bath. An electrical direct current was adjusted to a current density of 2 $A/dm^2$. The galvanic or electrolytic deposition was continued until a coating thickness of about 100 μm was obtained. Thereafter, the turbine blades were taken out of the bath and a polished section micrograph as shown in FIG. 1 was produced. The magnification was 500×. The micrograph indicates that the insertion rate of the powder particles in the matrix material corresponded to about 45% by volume. The micrograph also shows a very uniform coating structure.

After the completion of the foregoing, the turbine blades were subjected to a heat treatment for about 50 hours at a temperature of 1050° C. in an evacuated environment. It has been found that the alloy formation results in a coating or protecting film which is identical to that which can be achieved by conventional physical vapor deposition techniques or by thermal plasma spraying techniques. FIG. *2a* shows the elemental chromium distribution in a sample that was coated with Co-CrAlY, whereby the micrograph was made immediately after the deposition prior to any heat treatment. FIG. *2b* shows the elemental chromium distribution after the above mentioned heat treatment. The magnification X=1200.

Example 2 (For Comparing Purposes)

Figure 3:
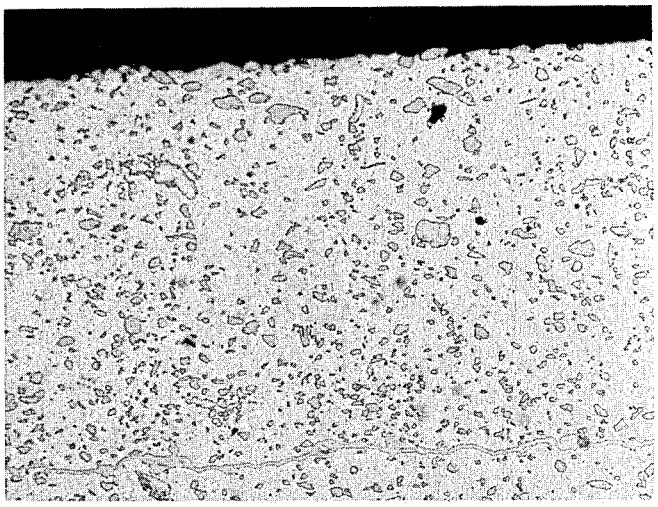
FIG. 3 illustrates, for comparing purposes, a micrograph polished section of a sample produced with a powder having milled powder particles not with a spherical configuration, whereby the magnification is the same as in FIG. 1.
Figure 2A:
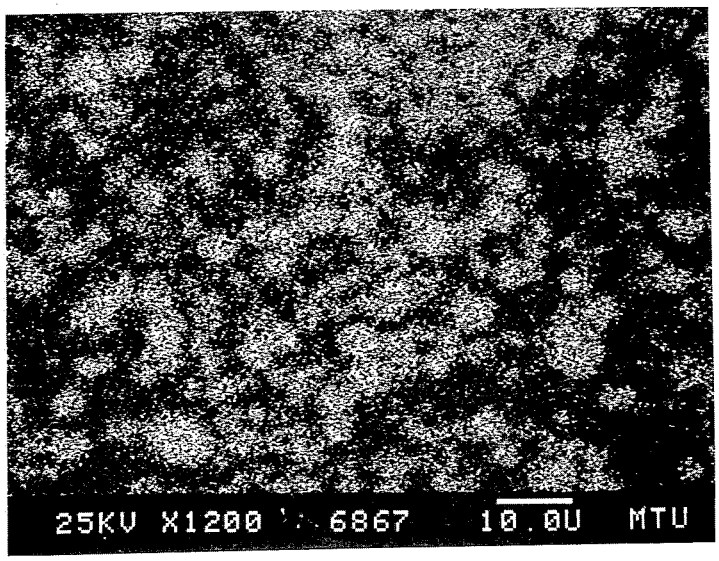
FIG. 2*a* is a micrograph of a polished section showing the particle distribution immediately after the electrolytic deposition.
Figure 2B:
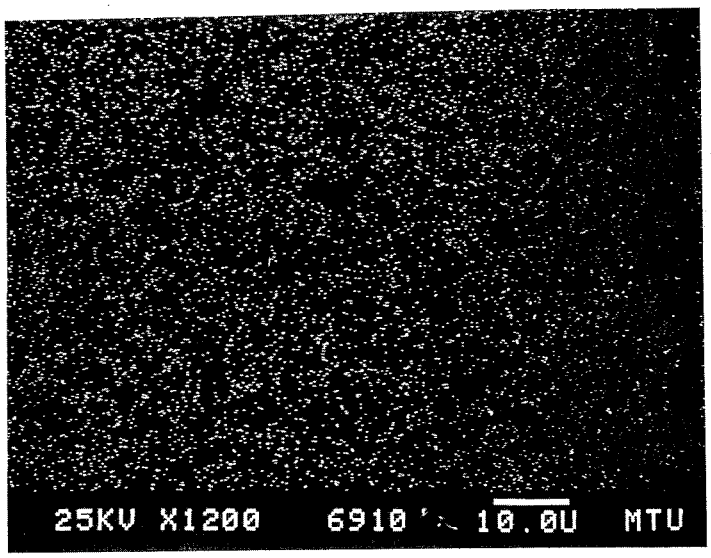
FIG. 2*b* is an image similar to that of FIG. 2, but showing the same sample after the annealing heat treatment.

A CrAlY powder was dispersed in the same electrolyte as in Example 1. The powder had a particle size smaller than 10 μm and a dispersion concentration of 300 g/l. However, the powder used in this second example was prepared by milling under an organic liquid, namely hydrocarbons. After the sample was coated as described above, a micrograph polished section was made as shown in FIG. 3. The magnification was 500×. The insertion rate obtained with such a powder of particles not having a spherical configuration was only 15% by volume.

Achieving a three times better insertion rate even with a suspension concentration which is only ⅓ of that used in Example 2 is truly surprising.

Example 3 (Prior Art)

Figure 4:
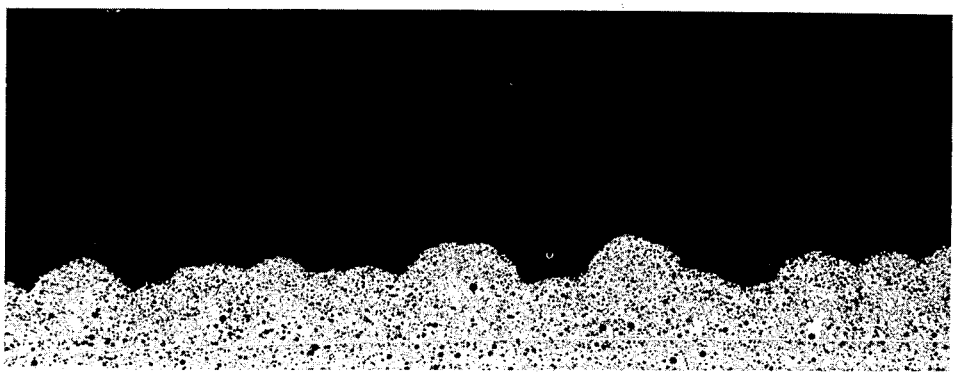
FIG. 4 is a comparing micrograph of a polished section produced from a sample manufactured in accordance with the prior art as described in the above mentioned article.

An electrolytic bath of cobalt of the same composition as used above in Examples 1 and 2 was introduced into a rotatable drum of the type described in the above mentioned article in the trade journal "Plating and Surface Finishing". CrAlY powder with particles of spherical configuration was then introduced into the electrolyte until a concentration of 5700 g/l were obtained. The powder had a particle size of less than 10 μm. FIG. 4 shows a polished section micrograph indicating an insertion rate of 35% by volume. However, the deposition obtained is rather non-uniform having wart-like protuberances as seen in FIG. 4. Further, the coating thickness was substantially larger along the edges of the sample than in the center of the sample in the form of a turbine blade. The magnification in FIG. 4 was 200×.

Although the invention has been described with reference to specific example embodiments, it is to be appreciated that it is intended to cover all modifications and equivalents within the scope of the appended claims.

Comparison of results of examples 1 and 2—which are based on the same technique but different configuration of particles—demonstrate the superiority of the spherical particles even with lower dispersion concentration in the electrolytic bath.

Comparison of results of examples 1 and 3—different techniques but same configuration of particles—demonstrate the superiority of the said process.

What we claim is:

1. A method for producing a protective coating on structural components intended for exposure to hot gas, comprising the following steps:

(a) preparing an electrolyte in which a matrix material of cobalt and/or nickel is contained, (b) preparing a metal alloy powder of aluminum and/or chromium having powder particles of spherical configuration, (c) passivating the surface of said spherical powder particles, (d) suspending said spherical powder particles in said electrolyte until a particle suspension concentration is reached within the range of 40 g/l to 100 g/l in the electrolyte, (e) immersing said structural component in an electrolytic bath prepared with said electrolyte, and performing a galvanic deposition until a coating having the desired thickness is obtained, and (f) removing the coated component from said electrolytic bath and subjecting the coated component to a heat treatment until an alloyed coating is formed.

2. The method of claim 1, wherein said particle suspension concentration is within the range of 40 to 60 g/l of the electrolyte.

3. The method of claim 1, wherein said spherical metal alloy powder particles are a CrAlY powder.

4. The method of claim 1, wherein said spherical metal alloy powder particles are selected from the group consisting of CrAlHf, CrAlYHf, CrAlTa, CrAlYta, CrNiAl, CrCoAl, CrAlSi, CrAl, and MoCrSi.

5. The method of claim 1, wherein said step of preparing said metal alloy powder is performed by spraying a respective hot alloy through a nozzle, thereby achieving a so-called atomizing resulting in spherical powder particles.

6. The method of claim 1, wherein said step of suspending said spherical powder particles in said electrolyte is performed by blowing the particles in an air flow into the electrolyte.

7. The method of claim 1, wherein said step of suspending said spherical powder particles in said electrolyte is performed by pumping said electrolyte in a circulating circuit at least while adding said particles to said electrolyte.

8. The method of claim 1, wherein said step of suspending said spherical powder particles in said electrolyte is perform by stirring said electrolyte at least while adding said particles to said electrolyte.

9. The method of claim 1, wherein said step of heat treatment is performed at a temperature within the range of about 900° C. to about 1100° C.

10. The method of claim 9, wherein said that heat treatment is applied for a time duration of about 5 hours to about 50 hours.

11. The method of claim 1, wherein said spherical powder particles have a particle size within the range of about 1 μm to about 15 μm.

* * * * *